US008531374B2

(12) United States Patent
Kao et al.

(10) Patent No.: US 8,531,374 B2
(45) Date of Patent: Sep. 10, 2013

(54) COMPENSATION CIRCUITRY OF GATE DRIVING PULSE SIGNAL AND DISPLAY DEVICE

(75) Inventors: Wei-Jen Kao, Hsin-Chu (TW); Shao-Chun Cheng, Hsin-Chu (TW); Chuo-Hsien Lin, Hsin-Chu (TW); Ming-Chang Shih, Hsin-Chu (TW); Chia-Kong Huang, Hsin-Chu (TW); Wen-Pin Chen, Hsin-Chu (TW); Shih-Chyn Lin, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 288 days.

(21) Appl. No.: 13/150,388

(22) Filed: Jun. 1, 2011

(65) Prior Publication Data

US 2012/0062534 A1 Mar. 15, 2012

(30) Foreign Application Priority Data

Sep. 9, 2010 (TW) ..... 99130553 A

(51) Int. Cl.
*G09G 3/36* (2006.01)

(52) U.S. Cl.
USPC ..... 345/98; 345/100

(58) Field of Classification Search
USPC ..... 345/98, 100
See application file for complete search history.

(56) References Cited

U.S. PATENT DOCUMENTS

| | | | | |
|---|---|---|---|---|
| 6,693,480 | B1 * | 2/2004 | Wong | 327/390 |
| 8,106,873 | B2 * | 1/2012 | Cheng et al. | 345/99 |
| 2005/0078102 | A1 * | 4/2005 | Kim | 345/204 |
| 2005/0184946 | A1 | 8/2005 | Pyoun et al. | |
| 2006/0071926 | A1 * | 4/2006 | Lee et al. | 345/211 |
| 2007/0052646 | A1 * | 3/2007 | Ishiguchi | 345/92 |
| 2007/0279232 | A1 * | 12/2007 | Halope et al. | 340/572.7 |

* cited by examiner

*Primary Examiner* — Kevin M Nguyen
(74) *Attorney, Agent, or Firm* — WPAT, PC; Justin King

(57) ABSTRACT

A compensation circuitry of gate driving pulse signal is adapted to receive a gate driving pulse signal and includes a pre-processing circuit, a peak detector, a discharge circuit, a voltage buffer and a charge pump circuit. The pre-preprocessing circuit performs a pre-processing operation to the gate driving pulse signal to adjust a voltage thereof. The pre-processed gate driving pulse signal then is transmitted to the peak detector for obtaining a peak voltage after a charging operation, and also is transmitted to the discharge circuit to determine whether to enable the discharge circuit so that providing the peak detector with a discharge loop when the discharge circuit is enabled. The charge pump circuit acquires the peak voltage through the voltage buffer and then modulates a waveform of the gate driving pulse signal according to the peak voltage. A display device using the above compensation circuitry also is provided.

20 Claims, 5 Drawing Sheets

COMPENSATION CIRCUITRY OF GATE DRIVING PULSE SIGNAL AND DISPLAY DEVICE

BACKGROUND

1. Technical Field

The present invention generally relates to display fields and, particularly to a compensation circuitry of gate driving pulse signal and a display device.

2. Description of the Related Art

Generally, current-voltage characteristics of thin film transistors in a gate-on-Array (GOA) circuit manufactured by the amorphous silicon process are easily changed when the ambient environments (e.g., temperature, pressure and so on) change, which would result in waveforms of gate driving pulse signals outputted from the GOA circuit being changed, i.e., a voltage difference between the highest-level voltage and the lowest-level voltage of each the gate driving pulse signal is excessively large or small. As a result, the display panel would have poor display quality or be unable to normally startup, and therefore the reliability of the display panel is degraded. Herein, the GOA circuit is a type of gate driving circuit directly manufactured on a display substrate of a display device and generally includes a plurality of cascade-connected shift registers for sequentially generating a plurality of gate driving pulse signals.

However, conventional compensation circuits for the GOA circuit only provide a compensation for the change of temperature, and thus could not solve the issue associated with the waveform change of gate driving pulse signal caused by other factors such as electrical stress, load and so on.

SUMMARY OF EMBODIMENTS

The present invention is directed to a compensation circuitry of gate driving pulse signal, for effectively improving the output of gate driving circuit.

The present invention is further directed to a display device, which can solve the issue of poor display quality or being unable to normally startup associated with a display panel by improving the output of gate driving circuit.

More specifically, a compensation circuitry of gate driving pulse signal in accordance with an embodiment of the present invention is adapted for receiving a gate driving pulse signal generated from a gate driving circuit in a frequency period. The compensation circuitry includes a pre-processing circuit, a peak detector, a discharge circuit, a voltage buffer and a charge pump circuit. The pre-preprocessing circuit performs a pre-processing operation to the gate driving pulse signal to adjust a voltage of the gate driving pulse signal. The peak detector receives the pre-processed gate driving pulse signal and performs a charging operation to obtain a peak voltage of the pre-processed gated driving pulse signal. The discharge circuit receives the pre-processed gate driving pulse signal and provides the peak detector with a discharge loop for discharge. An input terminal of the voltage buffer is electrically coupled to the peak detector for receiving the peak voltage. The charge pump circuit acquires the peak voltage from an output terminal of the voltage buffer and modulates a waveform of the gate driving pulse signal according to the peak voltage, so that a voltage difference between the highest-level voltage and the lowest-level voltage of the gate driving pulse signal is substantially constant in each the frequency period.

In one embodiment, the pre-processing circuit includes a voltage drop protection circuit and an amplifying and level shifting circuit. The voltage drop protection circuit is for performing a voltage dividing operation to the gate driving pulse signal. The amplifying and level shifting circuit is for performing amplifying and level shifting operations to the voltage-divided gate driving pulse signal and thereby obtaining the pre-processed gate driving pulse signal.

In one embodiment, the peak detector includes a holding diode and a holding capacitor. A positive terminal of the holding capacitor is electrically coupled to receive the pre-processed gate driving pulse signal, and a negative terminal of the holding capacitor serves as an output terminal of the peak voltage. The holding capacitor is electrically coupled between the negative terminal of the holding diode and a preset voltage level.

In one embodiment, the discharge circuit includes a high-pass filter, a switching element and a current source. An input terminal of the high-pass filter is electrically coupled to receive the pre-processed gate driving pulse signal, an output terminal of the high-pass filter is electrically coupled with the switching element to control ON-OFF states of the switching element, and the current source and the switching element are in the discharge loop when the switching element is ON state.

In one embodiment, the discharge circuit is triggered by a rising edge of the pre-processed gate driving pulse signal.

In one embodiment, the voltage buffer includes an amplifier, a non-inverting input terminal of the amplifier is electrically coupled to receive the peak voltage, an inverting input terminal of the amplifier is electrically coupled with an output terminal of the amplifier, and the output terminal of the amplifier outputs the peak voltage to the charge pump circuit.

In one embodiment, the charge pump circuit modulates the waveform of the gate driving pulse signal by regulating the lowest-level voltage of the gate driving pulse signal.

In one embodiment, the compensation circuitry further includes a boot acceleration circuit electrically coupled between an input terminal of the voltage buffer and an output terminal of the voltage buffer. The boot acceleration circuit is initiated to charge the peak detector when the input terminal and the output terminal of the voltage buffer have a voltage difference existed therebetween.

In one embodiment, the boot acceleration circuit includes a current source. Alternatively, the boot acceleration circuit includes a single diode or a plurality of diodes connected in series.

A display device in accordance with another embodiment of the present invention includes a gate driving circuit and the above-mentioned compensation circuitry of gate driving pulse signal. The gate driving circuit sequentially generates a plurality of gate driving pulse signals in a frequency period thereof. The compensation circuitry receives a designated one of the gate driving pulse signals and regulates the lowest-level voltage of each of the gate driving pulse signals according to the peak voltage of the designated gate driving pulse signal, so that a voltage difference between the highest-level voltage and the lowest-level voltage of each of the gate driving pulse signals is substantially constant in each the frequency period.

In one embodiment, the gate driving circuit includes a plurality of cascade-connected shift registers for sequentially generating the gate driving pulse signals. The designated gate driving pulse signal is generated by the last staged shift register in the cascade-connected shift registers. Herein, the last-staged shift register is the shift register for generating the last one of the gate driving pulse signals in the frequency period.

In the various embodiments of the present invention, by using the approach of analog feedback to achieve the output voltage compensation for the gate driving circuit, and thus is not limited to compensate the influence of temperature and can provide compensation for any factors effecting the output of the gate driving circuit. Moreover, the real-time peak detector constituted by the peak detector and the discharge circuit can readily carry out real-time detection and update for the peak voltage, and therefore can achieve the effect of continuous and real-time compensation for the output of the gate driving circuit.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. Accordingly, the descriptions will be regarded as illustrative in nature and not as restrictive.

Figure 1:
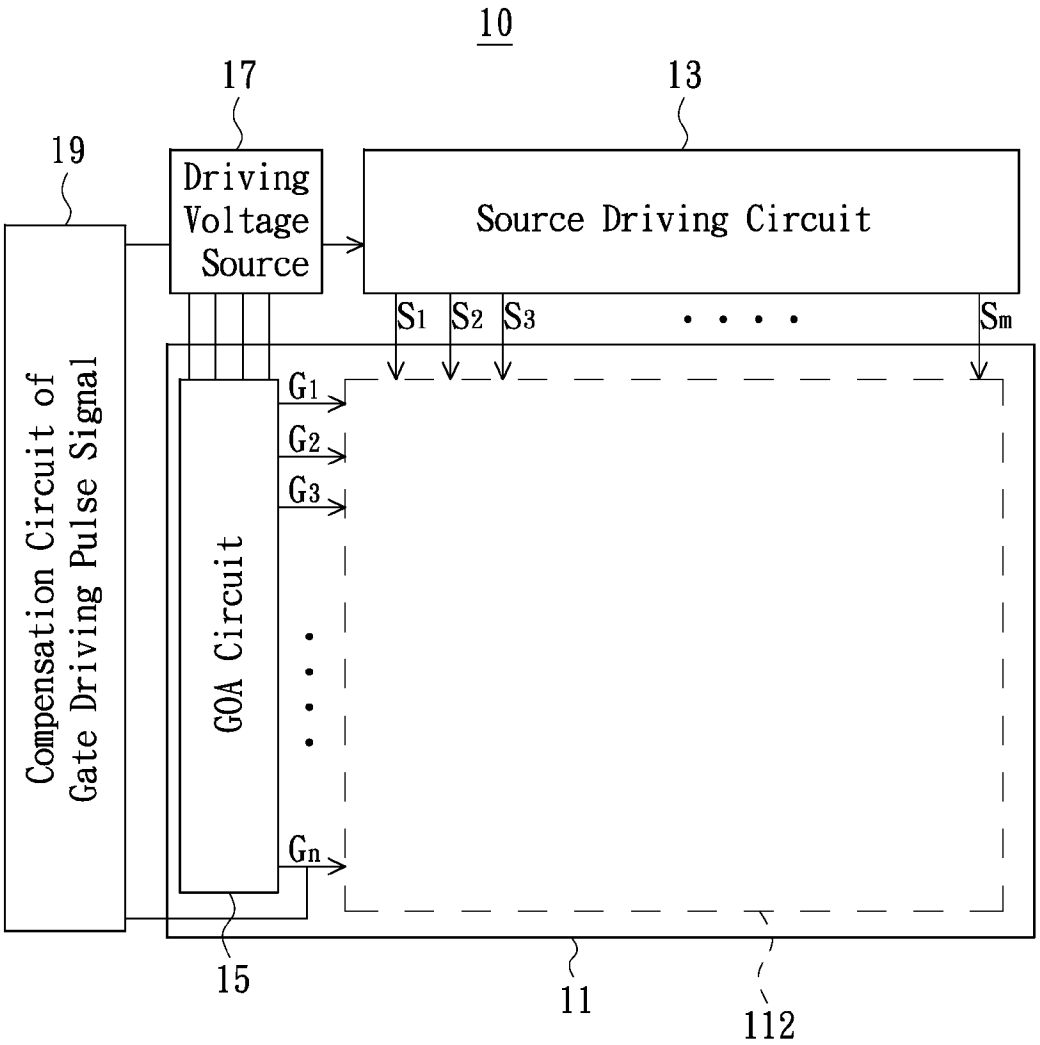
FIG. 1 shows a schematic structural block diagram of a display device in accordance with an embodiment of the present invention.

Referring to FIG. 1, a schematic structural block diagram of a display device in accordance with an embodiment of the present invention is shown. As illustrated in FIG. 1, the display device 10 includes a substrate 11, a source driving circuit 13, a GOA circuit 15, a driving voltage source 17 and a compensation circuitry of gate driving pulse signal 19. The substrate 11 includes a display region 112 and a peripheral region (not labeled in FIG. 1) at the periphery of the display region 112. The display region 112 have a thin film transistor (TFT) array and a plurality of pixel electrodes arranged therein, and the pixel electrodes are electrically coupled with the TFT array. The source driving circuit 13 is electrically coupled to the substrate 11 to provide the display region 112 with display data signal S1~Sm. The GOA circuit 15 is formed in the peripheral region of the substrate 11 and includes a plurality of cascade-connected shift registers for sequentially providing gate driving pulse signals G1~Gn in a frequency period (e.g., a frame period) to the display region 112. The driving voltage source 17 is electrically coupled to the source driving circuit 13, the GOA circuit 15 and the compensation circuitry of gate driving pulse signal 19, for providing an operating voltage(s) e.g., including an analog voltage and/or digital voltage thereto. The compensation circuitry of gate driving pulse signal 19 receives the gate driving pulse signal Gn generated from the GOA circuit 15. In the illustrated embodiment, m and n both are positive integers, and the gate driving pulse signal Gn is generated by the last-staged shift register in the GOA circuit 15. Herein, the last-staged shift register is a shift register for providing the last gate driving pulse signal in the frequency period.

Figure 2:
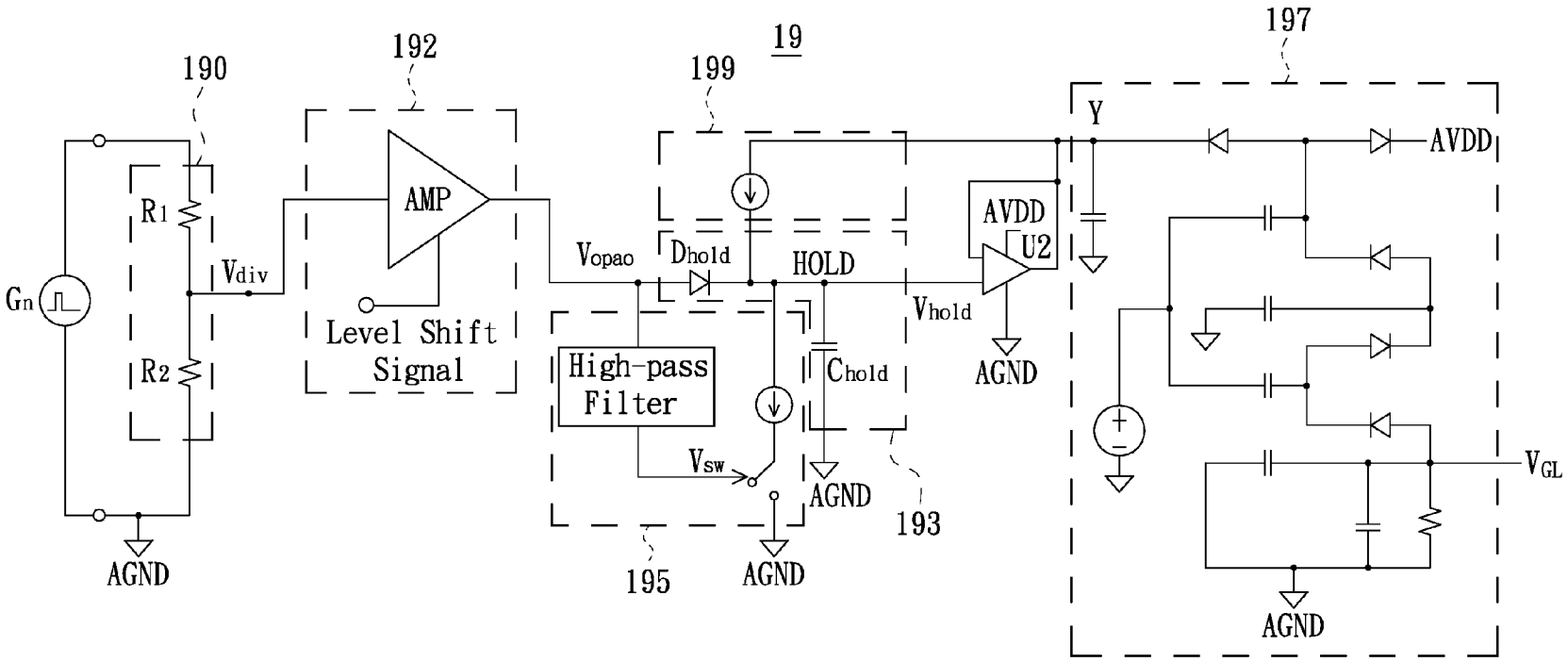
FIG. 2 shows an implementation of circuit structure for the compensation circuitry of gate driving pulse signal as shown in FIG. 1.

Referring to FIG. 2, an implementation of circuit diagram for the compensation circuitry of gate driving pulse signal 19 in accordance with an embodiment of the present invention is shown. As illustrated in FIG. 2, the compensation circuitry of gate driving pulse signal 19 includes a voltage drop protection circuit 190, an amplifying and level shifting circuit 192, a peak detector 193, a discharge circuit 195, a voltage buffer U2, a charge pump circuit 197 and a boot acceleration circuit 199.

The voltage drop protection circuit 190 and the amplifying and level shifting circuit 192 herein cooperatively constitute a pre-processing circuit. The pre-processing circuit performs a pre-processing operation to the gate driving pulse signal Gn before the gate driving pulse signal Gn is inputted to the peak detector 193, so as to suitably adjust the voltage e.g., voltage amplitude of the gate driving pulse signal Gn. In particular, the voltage drop protection circuit 190 receives the gate driving pulse signal Gn and then performs a voltage dividing operation to the gate driving pulse signal Gn for protecting the rear-end circuits and avoiding the highest-level voltage of the gate driving pulse signal Gn to burn down rear-end electronic components. Herein, the voltage drop protection circuit 190 includes, for example voltage-dividing resistors $R_1$, $R_2$ connected in series to perform the voltage-dividing operation to the gate driving pulse signal, and a connection node between the voltage-dividing resistors $R_1$ and $R_2$ outputs a pulse signal $V_{div}$. The amplifying and level shifting circuit 192 includes, for example an amplifier AMP, an input terminal of the amplifier AMP is electrically coupled to the node between the voltage-dividing resistors $R_1$ and $R_2$ to receive the pulse signal $V_{div}$ so as to perform an amplifying operation to the pulse signal $V_{div}$ by the amplifier AMP, a function terminal of the amplifier AMP receives a level shift signal to enable the amplifier AMP to perform a level shifting operation to the inputted pulse signal $V_{div}$, and an output terminal of the amplifier AMP outputs the amplified and level shifted pulse signal $V_{opao}$, i.e., the pre-processed gate driving pulse signal. Herein, a main purpose of the amplifying and level shifting operations is to make the lowest-level voltage $V_{GL}$ of the gate driving pulse signal outputted from the charge pump circuit 197 be linearly proportional to the gate driving pulse signal Gn on the prerequisite of the pulse signal $V_{opao}$ is in the output range of the amplifier AMP. The amplifying operation and the level shifting operation performed to the pulse signal Vdiv are without limited order.

The peak detector 193 receives the pulse signal $V_{opao}$ and performs a charging operation to obtain a peak voltage $V_{hold}$ of the pulse signal $V_{opao}$. More specifically, the peak detector 193 includes, for example a holding diode $D_{hold}$ and a holding capacitor $C_{hold}$. A positive terminal of the holding diode $D_{hold}$ is electrically coupled to the output terminal of the amplifier AMP to receive the pulse signal $V_{opao}$, and a negative terminal of the holding diode $D_{hold}$ serves as an output terminal of the peak voltage $V_{hold}$. The holding capacitor $C_{hold}$ is electrically coupled between the negative terminal of the holding diode $D_{hold}$ and a preset voltage level e.g., grounded voltage level AGND for charge storage. An electrical connection node between the holding diode $D_{hold}$ and the holding capacitor $C_{hold}$ is defined as node HOLD, and a voltage at the node HOLD is the peak voltage $V_{hold}$.

The discharge circuit 195 is subjected to the control of the pulse signal Vopao and for providing a discharge loop for the peak detector 193 to release charges after the discharge circuit 195 is enabled. In particular, the discharge circuit 195 includes, for example a high-pass filter, a switching element and a current source. An input terminal of the high-pass filter is electrically coupled to both the output terminal of the amplifier AMP and the positive terminal of the holding diode $D_{hold}$, an output terminal of the high-pass filter is electrically coupled with a control terminal of the switching element to control ON-OFF states of the switching element (e.g., a transistor) by outputting a control signal $V_{sw}$. A passage terminal of the switching element is electrically coupled to the grounded voltage level AGND, another passage terminal of the switching element is electrically coupled to a terminal of the current source, and another terminal of the current source is electrically coupled to the node HOLD. As a result, when the switching element is ON state, the switching element and the current source cooperatively provide a discharge loop to the holding capacitor $C_{hold}$ of the peak detector 193 for discharge.

Figure 3:
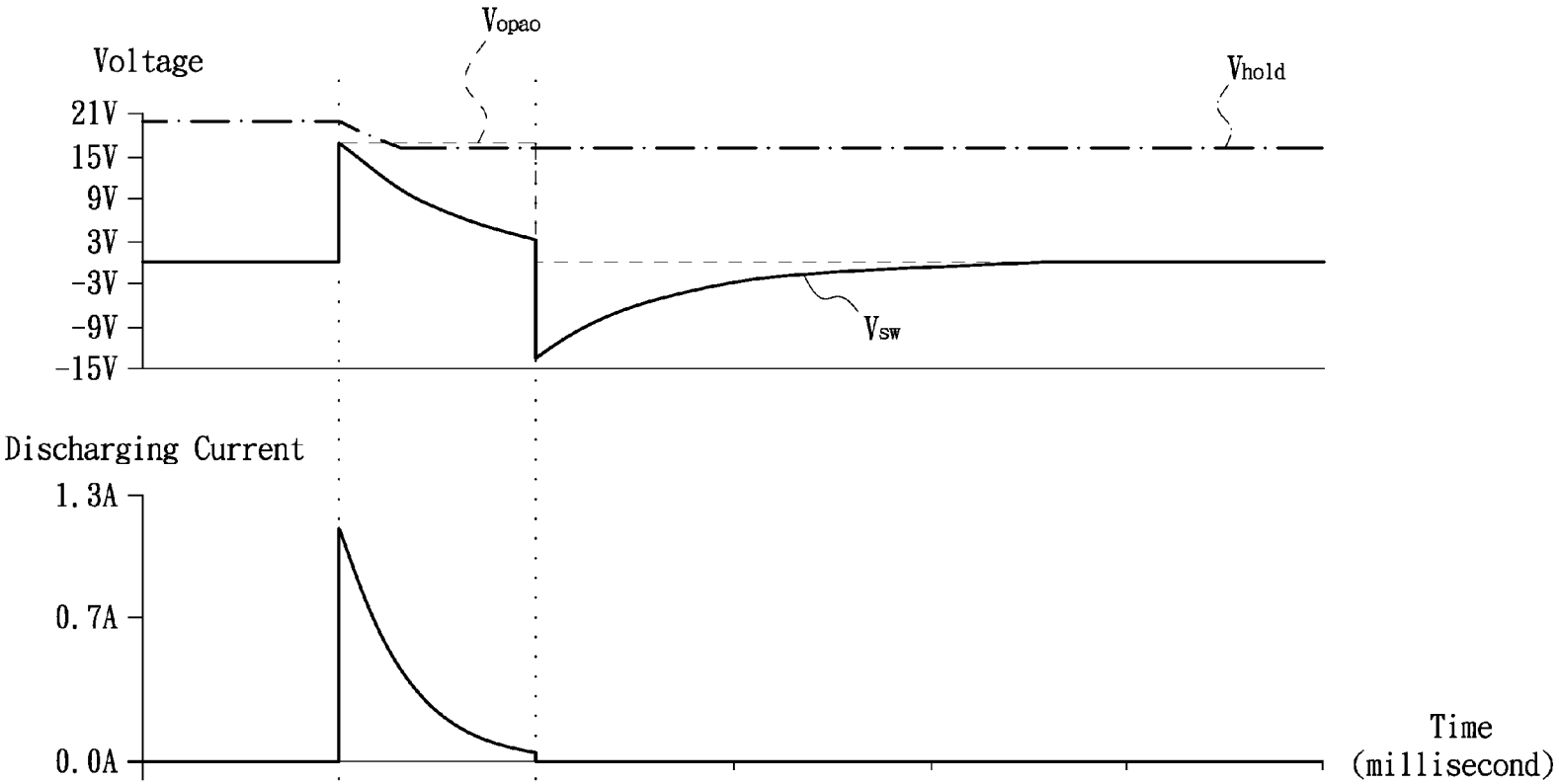
FIG. 3 shows an operation process of a discharge circuit as shown in FIG. 2.
Figure 4:
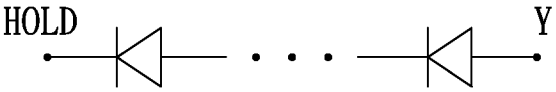
FIG. 4 shows another implementation of a boot acceleration circuit different from that as the illustration of FIG. 2.

Referring to FIG. 3, an operation process of the discharge circuit 195 in accordance with an embodiment of the present invention is shown. As illustrated in FIG. 3, when the pulse signal $V_{opao}$ jumps to a logic high, the output terminal of the high-pass filter of the discharge circuit 195 will output the control signal $V_{sw}$ as illustrated in FIG. 3 to the switching element to turn on the switching element and thereby the discharge loop is provided. In other words, the discharge circuit 195 is triggered by a rising edge of the pulse signal $V_{opao}$. Moreover, it is found from FIG. 3 that during the pulse signal $V_{opao}$ is maintained at the logic high, the discharge circuit 195 is continuously kept to be enabled, a discharging current on the discharge loop gradually decreases, and the peak voltage $V_{hold}$ firstly decreases and then keeps unchanged.

Returning to FIG. 2, the voltage buffer U2 is, for example an amplifier. A non-inverting input terminal of the amplifier is electrically coupled to the peak detector 193 for receiving the peak voltage $V_{hold}$, an inverting input terminal of the amplifier is electrically coupled with an output terminal of the amplifier, and the output terminal of the amplifier is electrically coupled to the charge pump circuit 197. Furthermore, an electrical connection node between the output terminal of the amplifier and the charge pump circuit 197 is defined as a node Y, two power supply terminals of the amplifier are respectively electrically coupled to a power supply voltage level AVDD and the grounded voltage level AGND. Herein, the configuration of the voltage buffer U2 facilitates to prevent the rear-end circuits from extracting charges on the holding capacitor $C_{hold}$ of the peak detector 193 and then achieve the purpose of stabilizing the peak voltage $V_{hold}$.

The charge pump circuit 197 acquires the peak voltage $V_{hold}$ from the output terminal of the voltage buffer U2 and regulates the lowest-level voltage $V_{GL}$ of each of the gate driving pulse signals G1~Gn according to the peak voltage $V_{hold}$. Correspondingly, the waveform of each of the gate driving pulse signals G1~Gn is modulated, so that a voltage difference between the highest-level voltage (not shown in FIG. 2) and the lowest-level voltage $V_{GL}$ of each of the gate driving pulse signals G1~Gn is kept to be substantially constant in each frequency period. Herein, the charge pump circuit 197 can employ a known circuit configuration and generally is comprised of electronic components such as capacitors, resistors, diodes and a voltage source, and electrical connection relationships among such the electronic components herein will not be repeated.

The boot acceleration circuit 199 is electrically coupled between the node HOLD and the node Y and is initiated to charge the holding capacitor $C_{hold}$ of the peak detector 193 when a voltage difference exists between the node HOLD and the node Y. The boot acceleration circuit 199 as illustrated in FIG. 2 is a current source. The current source is initiated when the node HOLD and the node Y have the voltage difference existed therebetween, and is turned off when no voltage difference exists between the node HOLD and the node Y. In another embodiment, the boot acceleration circuit 199 is not limited to be the current source, and can be multiple diodes in series connected between the node HOLD and the node Y instead. The amount of the diodes can be determined according to actual requirements. Of course, the amount of the diodes also can be a single one. In this embodiment, the configuration of the boot acceleration circuit 199 not only can dramatically shorten a time of the lowest-level voltage $V_{GL}$ arriving at an uncompensated normal voltage (e.g., −12 Volts) (i.e., the boot stabilizing time) when the GOA circuit 15 starts to operate, but also can solve the issue of transistor burn down or being unable to normally start up resulting from excessively large voltage difference between the highest-level voltage and the lowest-level voltage $V_{GL}$ caused by excessively low $V_{GL}$ when being booted up in the normal temperature.

Figure 5:
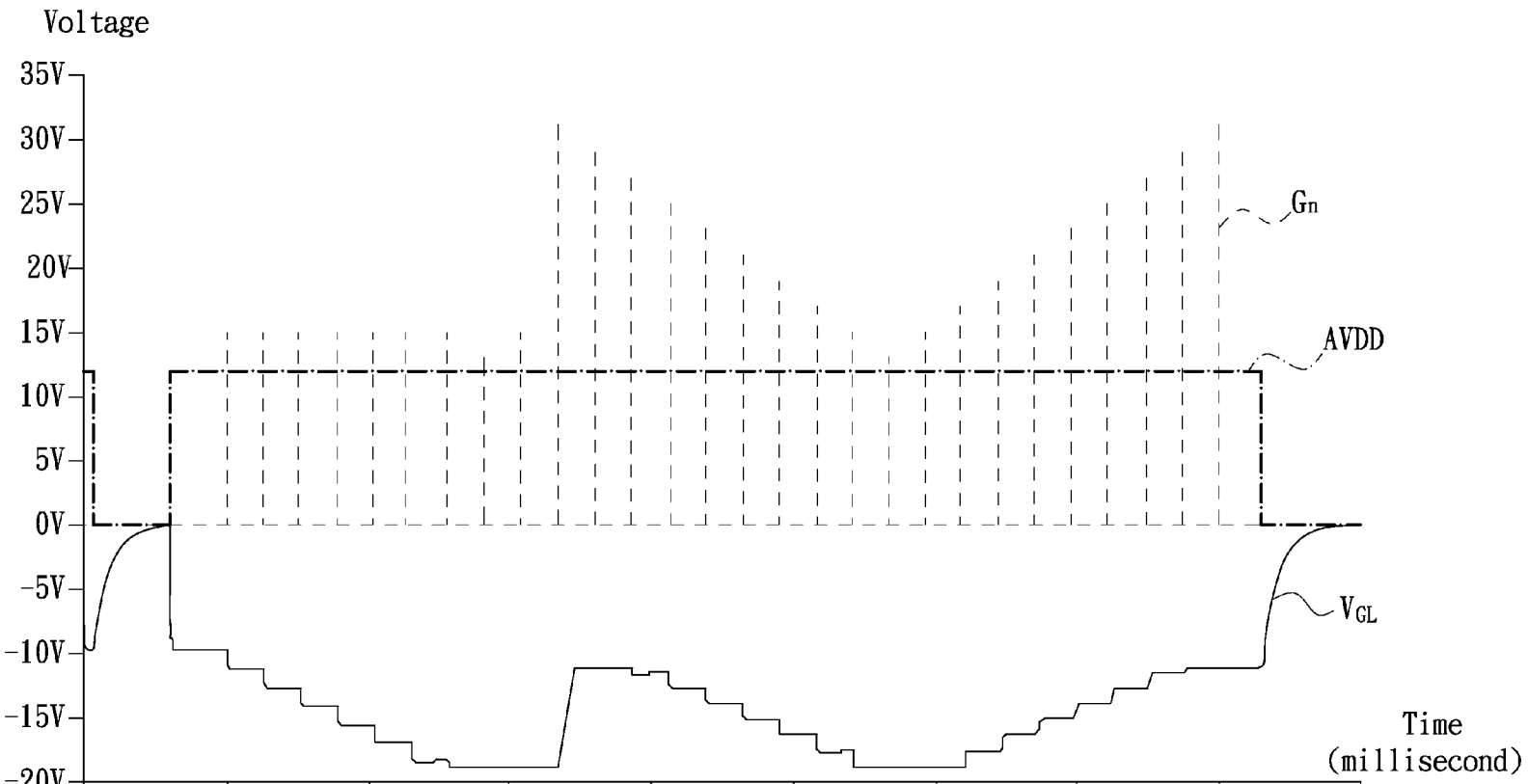
FIG. 5 shows simulated modulation effects about a lowest-level voltage of gate driving pulse signal in different situations in accordance with an embodiment of the present invention.

Referring to FIG. 5, showing simulated modulation effects about the lowest-level voltage $V_{GL}$ of each the gate driving pulse signal in various different situations. In FIG. 5, modulation effects about the lowest-level voltage $V_{GL}$ of the gate driving pulse signal Gn in the situations of powered on, the highest-level voltage of the gate driving pulse signal Gn gradually decreasing, the highest-level voltage of the gate driving pulse signal Gn gradually increasing and powered off are shown. It is noted that, since the scale on the horizontal coordinate of FIG. 5 is relatively large, the gate driving pulse signal Gn in FIG. 5 is represented by vertical lines. In other words, the vertical lines in FIG. 5 each represent a square wave signal. More specifically, it is found from FIG. 5 that: (1) in the situation of powered on, since there is a voltage difference existed between the node HOLD and the node Y, the boot acceleration circuit 199 is initiated to charge the holding capacitor $C_{hold}$ of the peak detector 193 and thereby the lowest-level voltage $V_{GL}$ of each the gate driving pulse signal can quickly drop from about 0 volt to about −10 volts; but if there is no boot acceleration circuit 199, the lowest-level voltage $V_{GL}$ would quickly drop from 0 volt to about −20 volts and then go back to about −10 volts after the first gate driving pulse signal. That is, the configuration of the boot acceleration circuit 199 can effectively shorten the boot stabilizing time of the lowest-level voltage $V_{GL}$. (2) in the situation of powered off, the lowest-level voltage $V_{GL}$ of each the gate driving pulse signal would be discharged to about 0 volt. (3) in the situation of normal operation after powered on and before powered off, the lowest-level voltage $V_{GL}$ of each the gate driving pulse signal can be regulated to increase along with the increase of the highest-level voltage and also to decrease along with the decrease of the highest-level voltage.

In summary, the present embodiment uses the peak voltage of the highest-level voltage of a certain one gate driving pulse signal (e.g., Gn) generated in the frequency period as a basis of regulating the lowest-level voltage $V_{GL}$ of each gate driving pulse signal, so that the voltage difference between the highest-level voltage and the lowest-level voltage of each gate driving pulse signal can be kept to be substantially constant by regulating the lowest-level voltage $V_{GL}$ and is without the issue of excessively large or small. As a result, as to the decrease or increase of the highest-level voltage of each the gate driving pulse signal caused by any factors, a corresponding lowest-level voltage $V_{GL}$ would be produced and thus can achieve the effect of continuous and real-time compensation for such factors.

Additionally, any skilled person in the art can make some modifications/changes to the display device and the compensation circuitry of gate driving pulse signal, for example suitably changing the circuit configurations of the functional circuits in the compensation circuitry of gate driving pulse signal, suitably increasing or decreasing the circuit blocks in the pre-processing circuit, and so on, such modifications/changes ought to be included in the scope and spirit of the present invention.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A compensation circuitry of gate driving pulse signal, adapted to receive a gate driving pulse signal generated from a gate driving circuit in a frequency period and comprising:

a pre-processing circuit for performing a pre-processing operation to the gate driving pulse signal to adjust a voltage of the gate driving pulse signal;

a peak detector electrically coupled to receive the pre-processed gate driving pulse signal and performing a charging operation to obtain a peak voltage of the pre-processed gate driving pulse signal;

a discharge circuit electrically coupled to receive the pre-processed gate driving pulse signal and provide a discharge loop to the peak detector;

a voltage buffer including an input terminal electrically coupled to the peak detector to receive the peak voltage; and a charge pump circuit for acquiring the peak voltage from an output terminal of the voltage buffer and modulating a waveform of the gate driving pulse signal according to the peak voltage, and thereby a voltage difference between the highest-level voltage and the lowest-level voltage of the gate driving pulse signal is kept to be substantially constant in each the frequency period.

2. The compensation circuitry of gate driving pulse signal as claimed in claim 1, wherein the pre-processing circuit comprises:

a voltage drop protection circuit for performing a voltage-dividing operation to the gate driving pulse signal; and an amplifying and level shifting circuit for performing amplifying and level shifting operations to the voltage-divided gate driving pulse signal and thereby obtaining the pre-processed gate driving pulse signal.

3. The compensation circuitry of gate driving pulse signal as claimed in claim 1, wherein the peak detector comprises a holding diode and a holding capacitor, a positive terminal of the holding diode is electrically coupled to receive the pre-processed gate driving pulse signal, a negative terminal of the holding diode serves as an output terminal of the peak voltage, and the holding capacitor is electrically coupled between the negative terminal of the holding diode and a preset voltage level.

4. The compensation circuitry of gate driving pulse signal as claimed in claim 1, wherein the discharge circuit comprises a high-pass filter, a switching element and a current source, an input terminal of the high-pass filter is electrically coupled to receive the pre-processed gate driving pulse signal, an output terminal of the high-pass filter is electrically coupled with the switching element to control ON-OFF states of the switching element, and the current source and the switching element are in the discharge loop when the switching element is ON state.

5. The compensation circuitry of gate driving pulse signal as claimed in claim 1, wherein the discharge circuit is trigged by a rising edge of the pre-processed gate driving pulse signal.

6. The compensation circuitry of gate driving pulse signal as claimed in claim 1, wherein the voltage buffer comprises an amplifier, a non-inverting input terminal of the amplifier is electrically coupled to receive the peak voltage, an inverting input terminal of the amplifier is electrically coupled with an output terminal of the amplifier, and the output terminal of the amplifier is for outputting the peak voltage to the charge pump circuit.

7. The compensation circuitry of gate driving pulse signal as claimed in claim 1, wherein the charge pump circuit modulates the waveform of the gate driving pulse signal by regulating the lowest-level voltage of the gate driving pulse signal.

8. The compensation circuitry of gate driving pulse signal as claimed in claim 1, further comprising:

a boot acceleration circuit, electrically coupled between the input terminal and the output terminal of the voltage buffer and being initiated to charge the peak detector when a voltage difference exists between the input terminal and the output terminal of the voltage buffer.

9. The compensation circuitry of gate driving pulse signal as claimed in claim 8, wherein the boot acceleration circuit comprises a current source.

10. The compensation circuitry of gate driving pulse signal as claimed in claim 8, wherein the boot acceleration circuit comprises a single diode or a plurality of diodes connected in series.

11. A display device comprising:

a gate driving circuit for sequentially generating a plurality of gate driving pulse signals in a frequency period; and a compensation circuitry of gate driving pulse signal, electrically coupled to receive a designated one of the gate driving pulse signals and for regulating the lowest-level voltage of each of the gate driving pulse signals according to a peak voltage of the designated gate driving pulse signal, and thereby a voltage difference between the highest-level voltage and the lowest-level voltage of each of the gate driving pulse signals is kept to be substantially constant in each the frequency period, the compensation circuitry of gate driving pulse signal comprising:

a pre-processing circuit for performing a pre-processing operation to the designated gate driving pulse signal to adjust a voltage of the designated gate driving pulse signal;

a peak detector electrically coupled to receive the pre-processed designated gate driving pulse signal and performing a charging operation to obtain the peak voltage of the pre-processed designated gate driving pulse signal;

a discharge circuit electrically coupled to receive the pre-processed designated gate driving pulse signal and providing a discharge loop to the peak detector;

a voltage buffer including an input terminal electrically coupled to the peak detector for receiving the peak voltage; and a charge pump circuit electrically coupled to an output terminal of the voltage buffer for receiving the peak voltage and regulating the lowest-level voltages of the gate driving pulse signals according to the peak voltage.

12. The display device as claimed in claim 11, wherein the pre-processing circuit comprises:

a voltage drop protection circuit for performing a voltage-dividing operation to the designated gate driving pulse signal; and an amplifying and level shifting circuit for performing amplifying and level shifting operations to the designated gate driving pulse signal and thereby obtaining the pre-processed designated gate driving pulse signal.

13. The display device as claimed in claim 11, wherein the peak detector comprises:

a holding diode, wherein a positive terminal of the holding diode is electrically coupled to receive the pre-processed designated gate driving pulse signal, and a negative terminal of the holding diode serves as an output terminal of the peak voltage; and a holding capacitor electrically coupled between the negative terminal of the holding diode and a preset voltage level.

14. The display device as claimed in claim 13, wherein the discharge circuit comprises:

a high-pass filter, wherein an input terminal of the high-pass filter is electrically coupled to the positive terminal of the holding diode;

a switching element comprising a control terminal, a first passage terminal and a second passage terminal, wherein the control terminal is electrically coupled with an output terminal of the high-pass filter, and the first passage terminal is electrically coupled to the preset voltage level; and a current source electrically coupled between the negative terminal of the holding diode and the second passage terminal of the switching element.

15. The display device as claimed in claim 11, wherein the discharge circuit is triggered by a rising edge of the pre-processed designated gate driving pulse signal.

16. The display device as claimed in claim 11, wherein the voltage buffer comprises an amplifier, a non-inverting input terminal of the amplifier is electrically coupled to receive the peak voltage, an inverting input terminal of the amplifier is electrically coupled with an output terminal of the amplifier, and the output terminal of the amplifier outputs the peak voltage to the charge pump circuit.

17. The display device as claimed in claim 11, further comprising:

a boot acceleration circuit, electrically coupled between the input terminal and the output terminal of the voltage buffer and being initiated to charge the peak detector when a voltage difference exists between the input terminal and the output terminal of the voltage buffer.

18. The display device as claimed in claim 17, wherein the boot acceleration circuit comprises a current source.

19. The display device as claimed in claim 17, wherein the boot acceleration circuit comprises a single diode or a plurality of diodes connected in series.

20. The display device as claimed in claim 11, wherein the gate driving circuit comprises a plurality of cascade-connected shift registers for sequentially generating the gate driving pulse signals, the designated gate driving pulse signal is generated by the last-staged shift register in the cascade-connected shifter registers.

* * * * *